US008215904B2

(12) United States Patent
Nakamura et al.

(10) Patent No.: US 8,215,904 B2
(45) Date of Patent: Jul. 10, 2012

(54) ASSEMBLING METHOD OF STATOR BLADE RING SEGMENT, STATOR BLADE RING SEGMENT, COUPLING MEMBER, WELDING METHOD

(75) Inventors: Ikuo Nakamura, Takasago (JP); Kunihiko Waki, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 453 days.

(21) Appl. No.: 12/449,828

(22) PCT Filed: Oct. 14, 2008

(86) PCT No.: PCT/JP2008/068535

§ 371 (c)(1),
(2), (4) Date: Oct. 20, 2009

(87) PCT Pub. No.: WO2009/051089

PCT Pub. Date: Apr. 23, 2009

(65) Prior Publication Data

US 2010/0135782 A1 Jun. 3, 2010

(30) Foreign Application Priority Data

Oct. 15, 2007 (JP) ..... 2007-267667

(51) Int. Cl.
*F04D 29/54* (2006.01)

(52) U.S. Cl. ..... 415/208.2; 415/215.1; 29/889.22

(58) Field of Classification Search ..... 29/889.22; 415/215.1, 208.2; 416/213 R
See application file for complete search history.

(56) References Cited

U.S. PATENT DOCUMENTS

| | | | | |
|---|---|---|---|---|
| 2,497,041 | A * | 2/1950 | Bodger | 415/209.4 |
| 4,912,299 | A | 3/1990 | Oros et al. | |
| 4,979,276 | A | 12/1990 | Chimento | |
| 5,022,818 | A * | 6/1991 | Scalzo | 415/209.3 |
| 5,074,749 | A * | 12/1991 | Fouillot et al. | 415/190 |
| 6,893,214 | B2 * | 5/2005 | Alford et al. | 415/138 |
| 2007/0122274 | A1 * | 5/2007 | Moorman et al. | 415/209.3 |
| 2010/0098537 | A1 | 4/2010 | Hamana | |

FOREIGN PATENT DOCUMENTS

| | | | |
|---|---|---|---|
| JP | S58-57276 | B2 | 12/1983 |
| JP | S59-2761 | B2 | 1/1984 |
| JP | H01-28245 | Y2 | 8/1989 |
| JP | H06-320277 | A | 11/1994 |
| JP | 2002-162391 | A | 6/2002 |
| JP | 2002-242611 | A | 8/2002 |
| JP | 2003-164983 | A | 6/2003 |

* cited by examiner

*Primary Examiner* — Edward Look
*Assistant Examiner* — Liam McDowell
(74) *Attorney, Agent, or Firm* — Manabu Kanesaka

(57) ABSTRACT

A groove 50 formed in each stator ring segment piece 41 is formed to have side wall portions 50*b* on opposite sides inclined with respect to a bottom 50*a* so that a width of the groove 50 gradually decreases from an outer peripheral side toward the bottom 50*a*. A coupling member 42 has a sectional shape so as to have a maximum width at protrusions 42*b* at an intermediate portion in a thickness direction. The protrusions 42*b* on the opposite sides abut against or approach the side wall portions 50*b* of the groove 50 when the coupling member 42 is placed in the groove 50, a space 100 is formed on the side of the bottom 50*a* of the groove 50, and a welding groove 200 having a substantially V-shaped section is formed on the side remote from the bottom 50*a* of the groove 50.

6 Claims, 7 Drawing Sheets

FIG. 7 Prior Art
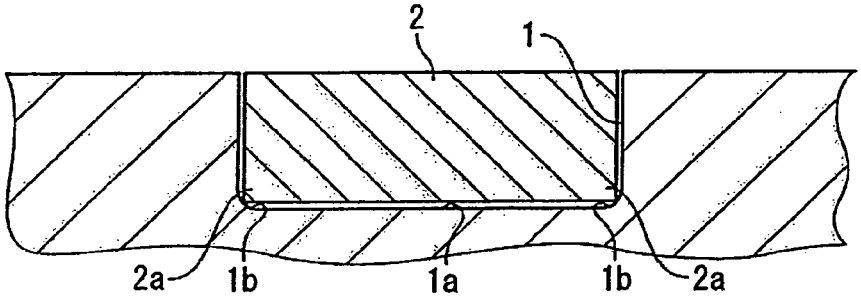

ASSEMBLING METHOD OF STATOR BLADE RING SEGMENT, STATOR BLADE RING SEGMENT, COUPLING MEMBER, WELDING METHOD

TECHNICAL FIELD

The present invention relates to an assembling method of a stator blade ring segment that constitutes a stator blade ring of an axial-flow compressor, a stator blade ring segment, a coupling member, or the like.

BACKGROUND ART

A stator blade ring of an axial-flow, compressor includes a plurality of, for example, several ten to several hundred stator blades arranged in a circumferential direction.

A conventionally often used method of assembling a stator blade ring is to circumferentially perform electron beam welding from side surfaces of an inner shroud and an outer shroud that form a cabin wall, with a stator blade being inserted between the inner shroud and the outer shroud and temporarily assembled, to join opposite ends of the stator blade and the inner shroud and the outer shroud (see Patent Documents 1 and 2).

Patent Document 1: Japanese Patent Publication No. 58-57276

Patent Document 2: Japanese Patent Publication No. 59-2761

DISCLOSURE OF THE INVENTION

Problems to be Solved by the Invention

However, in the conventional method, an electron beam is incident in an axial direction of the stator blade ring from the side surface of the shroud to the center of the stator blade over the entire circumference of the stator blade ring for welding. This causes a large amount of heat to be applied to the stator blade and the shroud. This heat may deform the stator blade and the shroud. The deformation of the stator blade disturbs airflow in the cabin to reduce compression efficiency of a compressor. The deformation of the shroud causes, for example, an inner side surface of the shroud to be corrugated to be protruded into or retracted from the cabin. This forms a step between a casing inner surface and a shroud inner surface in the cabin to disturb airflow in the cabin, leading to a reduction in compression performance.

The present invention is achieved in view of such technical problems, and has an object to provide an assembling method of a stator blade ring segment that can prevent the risk of thermal deformation and a reduction in strength, ensure flexibility of shape, and increase compression performance of a compressor.

Means for Solving the Problems

To solve the object, this applicant has proposed a stator blade ring including a plurality of stator blade ring segments, each of which is configured as described below (PCT/JP2007/62597).

Specifically, an inner shroud portion and an outer shroud portion circumferentially split so as to correspond to one stator blade are integrally formed with opposite ends of the stator blade to form a segment piece, a plurality of segment pieces are circumferentially arranged adjacent to each other, and a coupling member is provided on the side opposite to the stator blade in at least either of inner shroud portions or outer shroud portions of the plurality of segment pieces, and a part of a circumferential length of the segment piece is welded to the coupling member to form a stator blade ring segment.

With such a technique, the plurality of segment pieces are welded to the coupling member and thus coupled together. A part of the circumferential length of each segment piece is welded to the coupling member to allow a reduction in heat input. The segment pieces are welded one by one discontinuously, thereby allowing heat input to the segment pieces by welding to be dissipated into the air and reducing the risk of accumulation of heat. Also, the segment piece is welded to the coupling member provided on the side opposite to the stator blade in the inner shroud portion or the outer shroud portion, thereby reducing the influence of heat on the stator blade.

This can prevent the risk of thermal deformation of the formed stator blade ring. This prevents a flow of compressed gas from being disturbed due to thermal deformation, and allows predetermined compression performance to be maintained.

The inner shroud portion or the outer shroud portion in which the coupling member is provided is preferably formed with a groove portion that receives a band-shaped coupling member over the plurality of segment pieces. With the coupling member being placed in the groove portion, the coupling member is welded to the inner shroud portion or the outer shroud portion on opposite sides of the coupling member.

However, the inventors have diligently studied such a structure and found the following problems.

Specifically, the plurality of segment pieces are arranged, and the band-shaped coupling member is placed in the grooves formed in the inner shroud portions or the outer shroud portions of the segment pieces for welding. At first, the coupling member is in tight contact with a bottom surface of the groove with the coupling member being placed in the groove, but when welding is started, the coupling member rises from the groove. This may occur because bead penetrates or flux enters between the coupling member and the bottom surface of the groove during welding to cause the coupling member to rise. Also, the coupling member has residual stress when previously formed into an arcuate shape along the inner shroud portion or the outer shroud portion, and when heat is applied during welding, the residual stress may deform the coupling member to cause the above described phenomenon.

Also, each segment piece is formed with the groove by machining, but as shown in FIG. 7, it is difficult to form corners 1*b* on opposite sides of a bottom surface la of a groove 1 to have right angles (90°) in terms of machining. Thus, corners 2*a* of a coupling member 2 interfere with the corners 1*b* of the groove 1, and this may prevent the coupling member 2 from being brought into tight contact with the bottom surface 1*a* of the groove 1.

Thus, the inventors have made the present invention to solve the above described problems.

Specifically, the present invention provides an assembling method of a stator blade ring segment, a plurality of which are assembled to form a stator blade ring including a plurality of stator blades provided between an annular inner shroud and outer shroud, comprising the steps of: arranging a plurality of segment pieces each including one of the stator blades provided between an inner shroud portion formed by circumferentially splitting the inner shroud and an outer shroud portion formed by circumferentially splitting the outer shroud; and placing a band-shaped coupling member in a groove formed in a surface on the side opposite to a side provided with the stator blade in at least either of the inner shroud portion and the outer shroud portion, and welding the coupling member to at least either of the inner shroud portion and the outer shroud portion on opposite sides of the groove to couple the plurality of segment pieces with the coupling member in at least either of the inner shroud portion and the outer shroud portion.

As such, the plurality of segment pieces are welded to the coupling member and thus coupled together. Thus, as described above, a part of a circumferential length of each segment piece can be welded to the coupling member to reduce heat input. The segment pieces are welded one by one discontinuously, thereby allowing heat input to the segment pieces by welding to be dissipated into the air and reducing accumulation of heat. Also, the segment piece is welded to the coupling member provided on the side opposite to the stator blade in the inner shroud portion or the outer shroud portion, thereby reducing the influence of heat on the stator blade.

With such a method, in the present invention, the groove is formed to have a side wall portion inclined so that a width of the groove gradually decreases toward a bottom, the coupling member is formed such that when the coupling member is placed in the groove, a space is formed on the side of the bottom with respect to a protrusion and a welding groove having a substantially V-shaped section is formed on the side opposite to the bottom with respect to the protrusion between the side wall portion of the groove and a side surface of the coupling member, and welding is performed at the welding groove.

When the coupling member is welded to the segment piece, the space prevents the coupling member from interfering with the groove at a joint between opposite ends of the bottom and the side wall portion of the groove, thereby allowing the coupling member to be placed in tight contact with the bottom of the groove. Further, flux or an assist gas flows into the space during welding, and thus the flux or the assist gas does not cause the coupling member to rise from the groove to allow satisfactory welding at the welding groove.

In the step of coupling the plurality of segment pieces with the coupling member, it is preferable that a predetermined number of segment pieces are arranged so that an axial direction of each of the segment pieces is a substantially vertical direction, and the coupling member is placed in the continuous groove of the plurality of segment pieces arranged. Thus, welding is performed with the stator blade that constitutes the segment piece being transversely placed. This prevents a load from being applied to the stator blade, and prevents distortion or the like of the stator-blade.

It is preferable that among the plurality of segment pieces arranged, a segment piece at one end is welded to the coupling member and then a segment piece at the other end is welded to the coupling member, and then among the plurality of segment pieces arranged, segment pieces arranged on inner side are successively welded to the coupling member.

In the case where the coupling member has residual stress when previously formed into an arcuate shape along the inner shroud portion or the outer shroud portion, opposite ends of the coupling member are thus first welded to minimize the influence of deformation of the coupling member due to residual stress when heat is applied during welding, and allow smooth welding.

The present invention also provides a stator blade ring segment, a plurality of which are assembled to form a stator blade ring including a plurality of stator blades provided between an annular inner shroud and outer shroud. In the stator blade ring segment, a plurality of segment pieces are arranged each including one of the stator blades provided between an inner shroud portion formed by circumferentially splitting the inner shroud and an outer shroud portion formed by circumferentially splitting the outer shroud, and the plurality of segment pieces are coupled by welding a band-shaped coupling member placed in a groove formed in a surface on the side opposite to a side provided with the stator blade in at least either of the inner shroud portion and the outer shroud portion. The coupling member is formed with protrusions on opposite side surfaces in a width direction so as to have a maximum width at an intermediate portion in a thickness direction, the groove is formed to have a side wall portion inclined so that a width of the groove gradually decreases toward a bottom, and with the coupling member being placed in the groove, a space is formed on the side of the bottom of the groove with respect to the protrusion and a welding groove having a substantially V-shaped section is formed on the side opposite to the bottom with respect to the protrusion between the side wall portion of the groove and the side surface of the coupling member, and at least either of the inner shroud portion and the outer shroud portion is welded to the coupling member at the welding groove.

The present invention also provides a coupling member for coupling a plurality of segment pieces to form a stator blade ring segment, a plurality of which are assembled to form a stator blade ring including a plurality of stator blades provided between an annular inner shroud and outer shroud, the plurality of segment pieces each including one of the stator blades provided between an inner shroud portion formed by circumferentially splitting the inner shroud and an outer shroud portion formed by circumferentially splitting the outer shroud. The coupling member has a band shape and is formed with protrusions on opposite side surfaces in a width direction so as to have a maximum width at an intermediate portion in a thickness direction, and when the coupling member is placed in a groove formed in at least either of the inner shroud portion and the outer shroud portion of the segment piece, a space is formed on the side of the bottom of the groove with respect to the protrusion and a welding groove having a substantially V-shaped section is formed on the side opposite to the bottom with respect to the protrusion between the side wall portion of the groove and the side surface of the coupling member.

Such a coupling member couples the plurality of segment pieces by performing welding at the welding groove while being placed in the groove formed in at least either of the inner shroud portions and the outer shroud portions of the plurality of segment pieces.

The present invention may be applied to cases other than assembling of a stator blade ring segment of an axial-flow compressor. For example, the present invention may be applied to cases where a band-shaped member is welded to a groove like the stator blade ring segment and where a member such as a plug or a plate is placed in a recess of various shapes such as a circular shape for welding.

Specifically, the present invention provides a method of welding a first member formed with a groove or a recess to a second member placed in the groove or the recess at least at a part of an outer peripheral portion of the second member, wherein the groove or the recess has a side wall portion inclined so that an opening width of the groove or the recess gradually decreases toward a bottom, and the second member is formed with a protrusion on a side surface of the outer peripheral portion so as to have a maximum width at an intermediate portion in a thickness direction, when the second member is placed in the groove or the recess, a space is formed on the side of the bottom with respect to the protrusion and a welding groove having a substantially V-shaped section is formed on the side opposite to the bottom with respect to the protrusion between the side wall portion and the outer peripheral portion of the second member, and the welding groove is welded at least at a part of the outer peripheral portion of the second member to weld the first member to the second member.

When the first member is welded to the second member, the space prevents the second member from interfering with the groove or the recess in the outer peripheral portion of the bottom of the groove or the recess, thereby allowing the second member to be placed in tight contact with the bottom of the groove or the recess. Further, flux or an assist gas flows into the space during welding, and thus the flux or the assist gas does not cause the coupling member to rise from the groove. This allows satisfactory welding between the first member and the second member at the welding groove.

Advantages of the Invention

According to the present invention, the stator blade ring segments can be assembled using the coupling member with high accuracy, thereby preventing air from flowing into and out of the axial-flow compressor or the like and preventing deformation of the stator blade to prevent a flow of compressed air from being disturbed. This allows the axial-flow compressor to maintain predetermined compression performance to increase thermal efficiency of a gas turbine or the like.

According to the welding method of the present invention, the first member can be satisfactorily welded to the second member at the welding groove, thereby allowing the first member and the second member to be assembled with high accuracy.

BRIEF DESCRIPTION OF THE DRAWINGS

FIG. 7 shows a conventional technique and is a sectional view of a coupling member being placed in a groove formed in a segment piece.

DESCRIPTION OF SYMBOLS

20 . . . gas turbine, 32 . . . stator blade ring, 35 . . . inner shroud, 36 . . . outer shroud, 37 . . . stator blade, 40 . . . stator blade ring segment, 41 . . . segment piece, 42 . . . coupling member (second member), 42*a* . . . side surface, 42*b* . . . protrusion, 43 . . . stator blade, 44 . . . outer shroud portion (first member), 45 . . . inner shroud portion, 48 . . . welded spot, 50 . . . groove, 50*a* . . . bottom, 50*b* . . . side wall portion, 50*c* . . . part, 100 . . . space, 200 . . . welding groove, 300 . . . welding table

BEST MODE FOR CARRYING OUT THE INVENTION

Now, an embodiment of the present invention will be described in detail with reference to the accompanying drawings.

Figure 1:
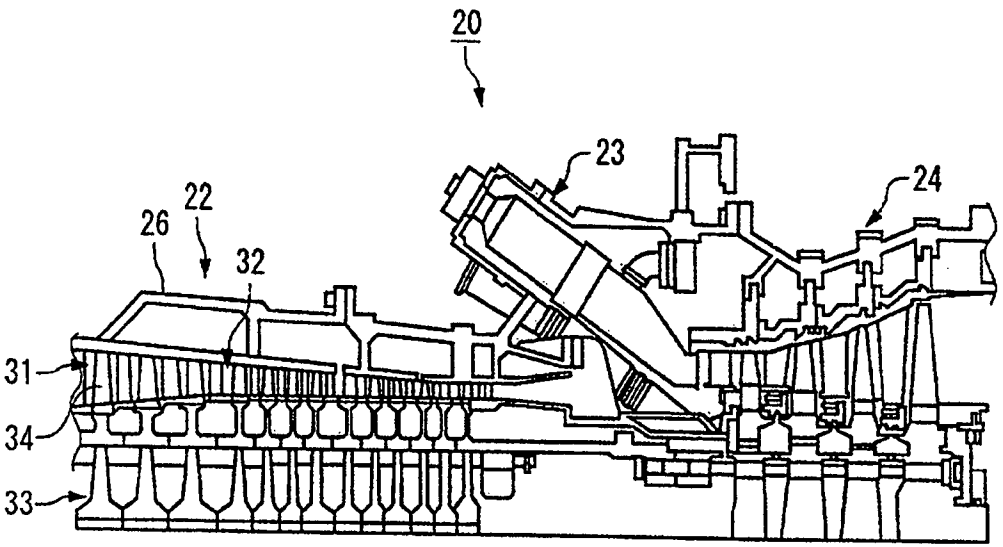
FIG. 1 shows a schematic configuration of a gas turbine according to an embodiment.

FIG. 1 illustrates a schematic configuration of a gas turbine 20 according to an embodiment.

As shown in FIG. 1, the gas turbine 20 includes an air inlet (not shown), a compressor 22, a combustor 23, and a turbine 24 from an upstream side to a downstream side of airflow. Air taken into the air inlet (not shown) is compressed by the compressor 22, and the high temperature and pressure compressed air is fed into the combustor 23. The combustor 23 supplies gas such as a natural gas or oil such as gas oil or light or heavy oil to the compressed air to burn fuel to generate a high temperature and pressure combustion gas. The high temperature and pressure combustion gas is injected to the turbine 24, and expands in the turbine 24 to rotate the turbine 24. Rotational energy of the turbine 24 drives a generator or the like connected to a spindle (not shown) of the gas turbine 20.

Components including the compressor 22, the combustor 23, and the turbine 24 that constitute the gas turbine 20 are covered with a casing 26.

The compressor 22 is an axial-flow compressor in which a rotor blade ring 31 and a stator blade ring 32 are alternately arranged in an axial direction of a rotating shaft 33.

The rotor blade ring 31 is constituted by a plurality of rotor blades 34 radially mounted around the rotating shaft 33. The plurality of rotor blades 34 are provided at regular intervals in a circumferential direction of the rotating shaft 33.

Figure 2:
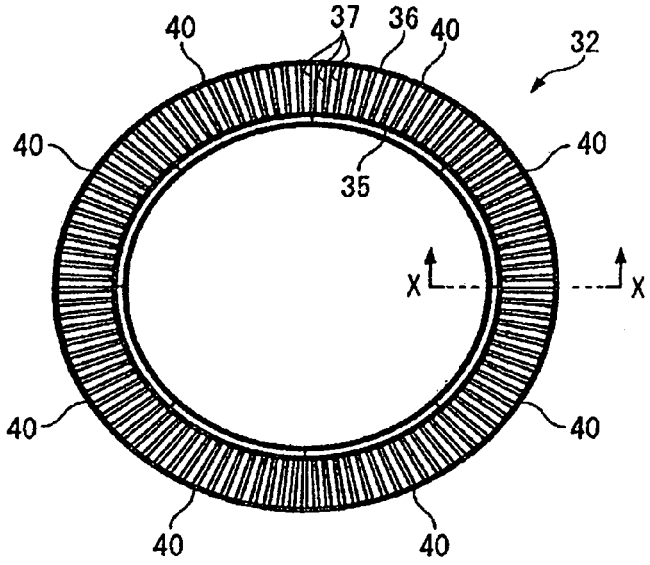
FIG. 2 shows a stator blade ring.

As shown in FIG. 2, the stator blade ring 32 is constituted by a plurality of stator blades 37 radially mounted between a ring-shaped inner shroud 35 and outer shroud 36. The plurality of stator blades 37 are provided at regular intervals in a circumferential direction of the stator blade ring 32. The stator blade ring 32 is constituted by stator blade ring segments 40 that are the inner shroud 35 and the outer shroud 36 circumferentially split into a plurality of (for example, 8) parts.

Figure 3:
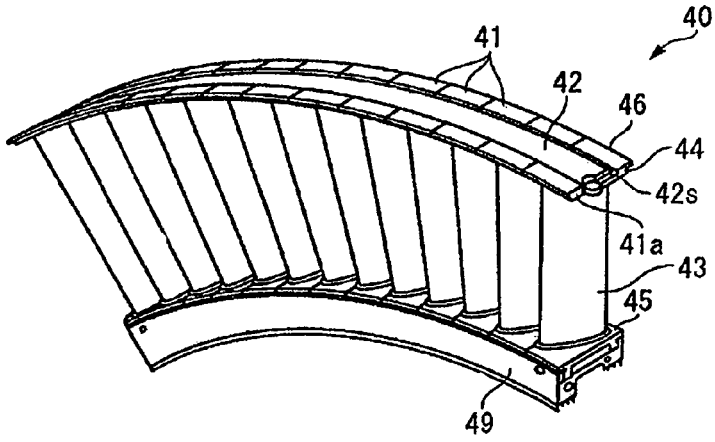
FIG. 3 is a perspective view of a stator blade ring segment that constitutes the stator blade ring.

As shown in FIG. 3, each stator blade ring segment 40 is constituted by a plurality of (for example, 10 to 20) segment pieces 41 coupled with an arcuate coupling member (second member) 42.

Each segment piece 41 includes one stator blade 43, an outer shroud portion (first member) 44 and an inner shroud portion 45 formed by splitting the inner shroud 35 and the outer shroud 36 so as to correspond to one stator blade 43. The stator blade 43, the outer shroud portion 44, and the inner shroud portion 45 are integrally formed by cutting from a block material of a predetermined material by a processing machine.

Figure 4:
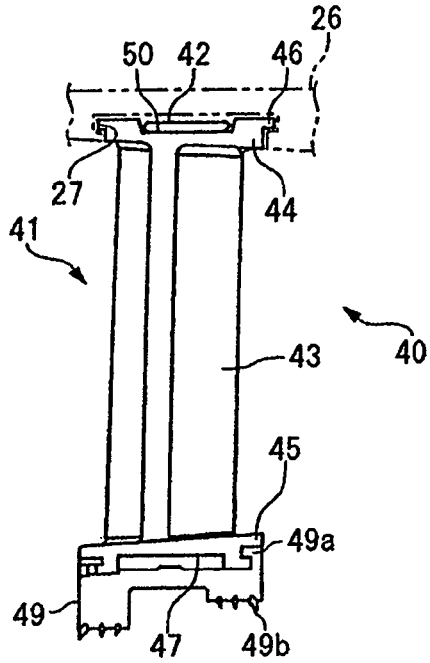
FIG. 4 shows a sectional shape of a segment piece.

As shown in FIG. 4, the outer shroud portion 44 has a band shape with a predetermined sectional shape, and is curved into an arcuate shape according to a curvature of the outer shroud 36. A groove 50 continuous in a circumferential direction of the outer shroud 36 is formed in an intermediate portion in a width direction of an outer peripheral surface (a surface on the side opposite to a surface provided with the stator blade 43) of the outer shroud portion 44. The coupling member 42 is placed in the groove 50.

Ridges 46 continuously protruding in the circumferential direction of the outer shroud 36 are formed at opposite ends in the width direction of the band-shaped outer shroud portion 44.

The inner shroud portion 45 has a band shape with a predetermined sectional shape, and is curved into an arcuate shape according to a curvature of the inner shroud 35. A groove 47 continuous in a circumferential direction of the inner shroud 35 is formed in an intermediate portion in a width direction of an inner peripheral surface (a surface on the side opposite to a surface provided with the stator blade 43) of the inner shroud portion 45.

The above described segment pieces 41 are integrated by the coupling member 42 to constitute the stator blade ring segment 40.

Figure 5:
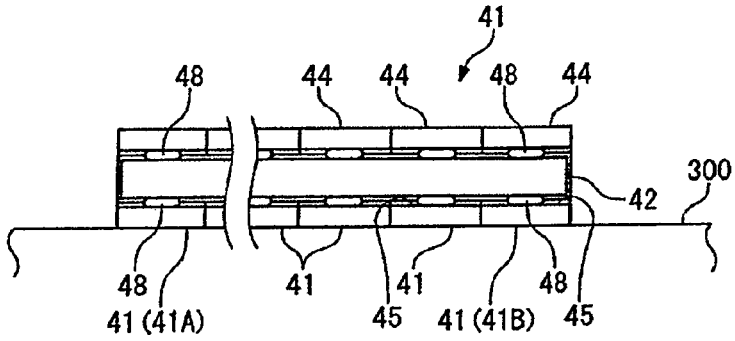
FIG. 5 shows a stator blade ring segment including a plurality of segment pieces coupled with a band-shaped coupling member.

The coupling member 42 couples the predetermined number of segment pieces 41 that constitute the stator blade ring segment 40, and has a band shape of a length according to the predetermined number of segment pieces 41. As described above, the coupling member 42 is placed in the groove 50 formed in the outer peripheral surface of the outer shroud portion 44. Then, the coupling member 42 is welded to each segment piece 41 on opposite sides in the width direction of the coupling member 42 to couple the predetermined number of segment pieces 41 to constitute the stator blade ring segment 40. As shown in FIG. 5, a welded spot 48 between the coupling member 42 and each segment piece 41 is placed so as not to be placed over adjacent segment pieces 41 and 41. This is because continuous welding over the adjacent segment pieces 41 and 41 may cause deformation or distortion in the stator blade ring segment 40 if thermal effect occurs in different manners between the adjacent segment pieces 41 and 41.

The coupling member 42 is mounted, while coupling the predetermined number of segment pieces 41, so that end surfaces 42*s* of the coupling member 42 do not protrude from end surfaces 41*a* of the segment pieces 41 at opposite ends that constitute the stator blade ring segment 40 but are located on inner sides by a predetermined size (for example, about 2.5 mm). This is for preventing contact between the coupling members 42 of the adjacent stator blade ring segments 40. This eliminates the need for mirror finishing or the like of the end surface 42*s* of the coupling member 42 and saves labor of machining.

The groove 50 formed in the outer shroud portion 44 and the coupling member 42 have the following sectional shapes.

Figure 6:
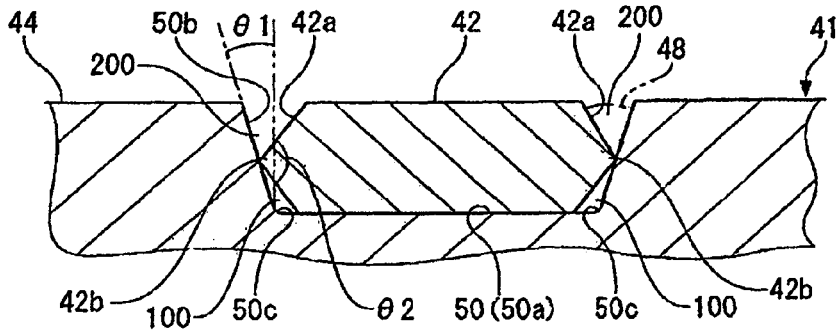
FIG. 6 is a sectional view of the coupling member being placed in a groove formed in the segment piece.

Specifically, as shown in FIG. 6, the groove 50 is formed to have a planar bottom 50*a* and side wall portions 50*b* on opposite sides in a width direction inclined at a predetermined angle θ1 with respect to the bottom 50*a* so that a width of the groove 50 gradually decreases from an outer peripheral side toward the bottom 50*a* when viewed in section. The angle θ1 is preferably 30° to 45°, and more preferably 33° to 37°. In this embodiment, for example, θ1=35°.

A radius of about 0.4 R is formed at a joint 50*c* between the opposite ends in the width direction of the bottom 50*a* and the side wall portion 50*b* for machining reasons.

Meanwhile, the coupling member 42 has a sectional shape so as to have a maximum width at an intermediate portion in a thickness direction. Specifically, protrusions 42*b* are formed at intermediate portions in a thickness direction on side surfaces 42*a* on opposite sides in a width direction of the coupling member 42. The protrusion 42*b* is formed, for example, at a position 2 mm from a surface facing the bottom 50*a* of the groove 50 with the coupling member 42 being placed in the groove 50 when the coupling member 42 has a thickness of 6 mm. The protrusions 42*b* on the opposite sides are formed to abut against or approach the side wall portions 50*b* of the groove 50 when the coupling member 42 is placed in the groove 50. Then, a vertex angle θ2 of the protrusion 42*b* is set to a predetermined angle. In this embodiment, for example, θ2=120°. Thus, the side surfaces 42*a* are inclined at the same angle with respect to a direction perpendicular to the bottom 50*a* of the groove 50 at upper and lower portions of the protrusions 42*b*, and inclined at 30° in this embodiment.

When the coupling member 42 having such a sectional shape is placed in the groove 50, the protrusions 42*b* on the opposite sides abut against or approach the side wall portions 50*b* of the groove 50, a space 100 surrounded by the side surface 42*a* of the coupling member 42 and the side wall portion 50*b* and the bottom 50*a* of the groove 50 is formed on the side of the bottom 50*a* of the groove 50, and a welding groove 200 having a substantially V-shaped section is formed on the side remote from the bottom 50*a* of the groove 50.

The coupling member 42 is placed in the groove 50 formed in the outer peripheral surface of the outer shroud portion 44, and the coupling member 42 is welded to each segment piece 41 at predetermined welded spots 48 on opposite sides in the width direction of the coupling member 42. TIG welding can be used for this welding. In the welded spot 48, welding is performed at the welding groove 200 having a substantially V-shaped section. At this time, the space 100 is formed on the lower side of the protrusion 42*b* below the welding groove 200. The space 100 forms a clearance between the joint 50*c* between the opposite ends of the bottom 50*a* and the side wall portion 50*b* of the groove 50 and the opposite ends of the coupling member 42. As described above, a minute radius is formed at the joint 50*c* between the opposite ends of the bottom 50*a* and the side wall portion 50*b* of the groove 50 for machining reasons, and thus generally, corners at opposite ends of the coupling member 42 interfere with the joints 50*c* to make it difficult to bring the coupling member 42 into tight contact with the bottom 50*a* of the groove 50. The above described configuration allows the coupling member 42 to be placed in tight contact with the bottom 50*a* of the groove 50.

Further, assist gas flows into the space 100 and flows in a continuous direction of the groove 50 during welding, and thus the assist gas does not cause the coupling member 42 to rise from the groove 50, thereby allowing satisfactory welding at the welding groove 200.

As such, each stator blade ring segment 40 constituted by coupling the predetermined number of segment pieces 41 with the coupling member 42 is circumferentially slidably held by the casing 26 on the outer peripheral side of the stator blade ring segment 40 as shown in FIG. 4. For this purpose, a guide groove 27 is formed in an inner peripheral surface of the casing 26. The guide groove 27 has a sectional shape corresponding to the ridge 46 formed on the outer shroud portion 44 of each segment piece 41. Thus, the stator blade ring 32 constituted by an assembly of the plurality of segment pieces 41 is held at the outer shroud 36 by the casing 26 slidably in a continuous direction of the guide groove 27, that is, in the circumferential direction.

A radial position of each stator blade ring segment 40 is held by a seal holder 49 with respect to a spindle (not shown) on an inner peripheral side of the stator blade ring segment 40. The seal holder 49 has a length corresponding to the stator blade ring segment 40. The seal holder 49 is formed with a fitting portion 49*a* that fits the inner shroud portion 45 of each segment piece 41. A seal member 49*b* is provided on an inner peripheral side of the seal holder 49 to ensure sealability with the spindle (not shown).

The stator blade ring segments 40 are successively inserted and placed into the guide groove 27 formed in the casing 26 to constitute a generally annular stator blade ring 32.

Each stator blade ring segment 40 is assembled as described below.

The segment piece 41 is formed by cutting a block material of a predetermined material. The coupling member 42 is formed by machining a band-shaped plate material of a predetermined material to have a predetermined sectional shape of the coupling member 42, and then curving the material into an arcuate shape having a predetermined radius of curvature.

Then, the predetermined number of segment pieces 41 are coupled by the coupling member 42.

For this purpose, the predetermined number of segment pieces 41 previously prepared are placed on a welding table. In this embodiment, as shown in FIG. 5, the segment pieces 41 are transversely placed on the welding table 300 (so that a rotating shaft direction is perpendicular to an upper surface of the welding table 300).

The plurality of segment pieces 41 are brought into tight contact with each other by a jig and positioned on the welding table 300. In this state, the plurality of segment pieces 41 are temporarily joined by spot welding, and then the groove 50 is machined to be continuous.

Then, the coupling member 42 is placed in the groove 50.

Then, the coupling member 42 is welded to the segment pieces 41.

At this time, as the order of welding, as shown in FIG. 5, a segment piece 41A at one end is first welded among the plurality of segment pieces 41, and then a segment piece 41B at the other end is welded. Then, segment pieces 41 located on inner side are preferably alternately welded on opposite sides.

Such welding with the segment piece 41 being transversely placed can prevent the stator blade 43 from being distorted by a load or thermal stress.

The predetermined number of segment pieces 41 are coupled by the coupling member 42 to assemble the stator blade ring segment 40, and the seal holder 49 is mounted to the inner peripheral side of the stator blade ring segment 40.

All the stator blade ring segments 40 that constitute the stator blade ring 32 are assembled in the same manner as above. Then, the assembled stator blade ring segments 40 are successively inserted and placed into the guide groove 27 formed in the casing 26 to constitute the generally annular stator blade ring 32.

In the above described manner, the segment piece 41 is welded to the coupling member 42 at the welded spot 48, only at a part of a circumferential length of the outer shroud portion 44. Also, a welding depth is only a depth of the welding groove 200. Thus, heat input to the segment piece 41 is smaller than that in a conventional case where heat is input to an axial center of a stator blade ring over the entire circumference by electron beam welding. Also, the segment pieces 41 are individually welded to the coupling member 42 at each welded spot 48 discontinuously, thereby allowing heat caused by welding to be dissipated into the air and reducing the risk of accumulation of heat.

The welded spot 48 is located on the side opposite to the side provided with the stator blade 43 in the outer shroud portion 44, thereby reducing the influence of heat caused by welding on the stator blade 43.

As such, the formed stator blade ring segment 40 can prevent deformation or distortion caused by thermal effect. This can prevent air from flowing into and out of the outer shroud 36 and prevent deformation of the stator blade 43 to prevent a flow of compressed air from being disturbed. This allows the compressor 22 to maintain predetermined compression performance to increase thermal efficiency of the gas turbine 20.

The groove 50 formed in each segment piece 41 is formed to have the side wall portions 50*b* on the opposite sides inclined with respect to the bottom 50*a* so that the width of the groove 50 gradually decreases from the outer peripheral side toward the bottom 50*a* when viewed in section, and the coupling member 42 has a sectional shape so as to have a maximum width at the protrusions 42*b* at the intermediate portion in the thickness direction. Thus, the protrusions 42*b* on the opposite sides abut against or approach the side wall portions 50*b* of the groove 50 when the coupling member 42 is placed in the groove 50, the space 100 is formed on the side of the bottom 50*a* of the groove 50, and the welding groove 200 having a substantially V-shaped section is formed on the side remote from the bottom 50*a* of the groove 50.

When such a coupling member 42 is welded to the segment piece 41, the space 100 forms a clearance between the joint 50*c* between the opposite ends of the bottom 50*a* and the side wall portion 50*b* of the groove 50 and the opposite ends of the coupling member 42, thereby allowing the coupling member 42 to be placed in tight contact with the bottom 50*a* of the groove 50. Further, flux or assist gas flows into the space 100 and flows in the continuous direction of the groove 50 during welding, and thus the flux or assist gas does not cause the coupling member 42 to rise from the groove 50, thereby allowing satisfactory welding at the welding groove 200.

As such, the stator blade ring segments 40 can be assembled using the coupling member 42 with high accuracy, and this also prevents air from flowing into and out of the outer shroud 36 and prevents deformation of the stator blade 43 to prevent a flow of compressed air from being disturbed. This allows the compressor 22 to maintain predetermined compression performance to increase thermal efficiency of the gas turbine 20.

In the above described embodiment, the present invention is applied to the welded spot 48 for coupling the plurality of segment pieces 41 with the coupling member 42 in the stator blade ring segment 40 that constitutes the gas turbine 20. Other components of the gas turbine 20 that do not relate to the gist of this application may have other configurations.

As long as an object to be welded is placed in a groove or a recess and welded, not limited to the case where the coupling member 42 is placed in the groove 50 and welded, the present invention may be applied to other objects, for example, in a case where a plug or a plate is welded to a circular or rectangular recess. This can provide the same advantage as above of preventing the object to be welded from rising from the recess and allowing satisfactory welding.

Further, the configurations described in the embodiment may be chosen or changed to other configurations without departing from the gist of the present invention.

The invention claimed is:

1. An assembling method of a stator blade ring segment, a plurality of which are assembled to form a stator blade ring including a plurality of stator blades provided between an annular inner shroud and outer shroud, comprising the steps of:

arranging a plurality of segment pieces each including one of said stator blades provided between an inner shroud portion formed by circumferentially splitting said inner shroud and an outer shroud portion formed by circumferentially splitting said outer shroud; and placing a band-shaped coupling member in a groove formed in a surface on the side opposite to a side provided with said stator blade in at least either of said inner shroud portion and said outer shroud portion, and welding said coupling member to at least either of said inner shroud portion and said outer shroud portion on opposite sides of said groove to couple said plurality of segment pieces with said coupling member in at least either of the inner shroud portion and the outer shroud portion, wherein said groove is formed to have a side wall portion inclined so that a width of the groove gradually decreases toward a bottom, and said coupling member is formed with protrusions on opposite side surfaces in a width direction, and when said coupling member is placed in said groove, a space is formed on the side of said bottom with respect to said protrusion and a welding groove having a substantially V-shaped section is formed on the side opposite to said bottom with respect to said protrusion between the side wall portion of said groove and said side surface of said coupling member, and welding is performed at said welding groove.

2. The assembling method of a stator blade ring segment according to claim 1, wherein in the step of coupling said plurality of segment pieces with said coupling member, a predetermined number of said segment pieces are arranged so that an axial direction of each of said segment pieces is a substantially vertical direction, and said coupling member is placed in the continuous groove of said plurality of segment pieces arranged.

3. The assembling method of a stator blade ring segment according to claim 2, wherein among said plurality of segment pieces arranged, a segment piece at one end is welded to said coupling member and then a segment piece at the other end is welded to said coupling member, and then among said plurality of segment pieces arranged, segment pieces arranged on inner side are successively welded to said coupling member.

4. A stator blade ring segment, a plurality of which are assembled to form a stator blade ring including a plurality of stator blades provided between an annular inner shroud and outer shroud, wherein a plurality of segment pieces are arranged each including one of said stator blades provided between an inner shroud portion formed by circumferentially splitting said inner shroud and an outer shroud portion formed by circumferentially splitting said outer shroud, and said plurality of segment pieces are coupled by welding a band-shaped coupling member placed in a groove formed on the side opposite to a side provided with said stator blade in at least either of said inner shroud portion and said outer shroud portion, said coupling member is formed with protrusions on opposite side surfaces in a width direction so as to have a maximum width at an intermediate portion in a thickness direction, said groove is formed to have a side wall portion inclined so that a width of the groove gradually decreases toward a bottom, and with said coupling member being placed in said groove, a space is formed on the side of said bottom with respect to said protrusion and a welding groove having a substantially V-shaped section is formed on the side opposite to said bottom with respect to said protrusion between the side wall portion of said groove and said side surface of said coupling member, and at least either of said inner shroud portion and said outer shroud portion is welded to said coupling member at said welding groove.

5. A coupling member for coupling a plurality of segment pieces to form a stator blade ring segment, a plurality of which are assembled to form a stator blade ring including a plurality of stator blades provided between an annular inner shroud and outer shroud, the plurality of segment pieces each including one of said stator blades provided between an inner shroud portion formed by circumferentially splitting said inner shroud and an outer shroud portion formed by circumferentially splitting said outer shroud, said coupling member has a band shape and is formed with protrusions on opposite side surfaces in a width direction so as to have a maximum width at an intermediate portion in a thickness direction, and when said coupling member is placed in a groove formed in at least either of said inner shroud portion and said outer shroud portion of said segment piece, a space is formed on the side of the bottom of said groove with respect to said protrusion and a welding groove having a substantially V-shaped section is formed on the side opposite to said bottom with respect to said protrusion between the side wall portion of said groove and said side surface of said coupling member.

6. A method of welding a first member formed with a groove or a recess to a second member placed in said groove or said recess at least at a part of an outer peripheral portion of said second member, wherein said groove or said recess has a side wall portion inclined so that an opening width of the groove or the recess gradually decreases toward a bottom, and said second member is formed with a protrusion on a side surface of the outer peripheral portion so as to have a maximum width at an intermediate portion in a thickness direction, when said second member is placed in said groove or said recess, a space is formed on the side of said bottom with respect to said protrusion and a welding groove having a substantially V-shaped section is formed on the side opposite to said bottom with respect to said protrusion between said side wall portion and the outer peripheral portion of said second member, and said welding groove is welded at least at a part of the outer peripheral portion of said second member to weld said first member to said second member.

* * * * *